US006991527B2

(12) United States Patent
Linzell

(10) Patent No.: US 6,991,527 B2
(45) Date of Patent: Jan. 31, 2006

(54) APPLICATOR TOOL FOR TREATING SURFACES

(76) Inventor: Geoffrey Robert Linzell, 12 Brooksmans Avenue, Brooksmans Park, Hatfield, Herts (GB), AL9 7QJ ( * ) Notice: Subject to any disclaimer, the term of this patent is extended or adjusted under 35 U.S.C. 154(b) by 0 days.

(21) Appl. No.: 10/276,648

(22) PCT Filed: May 17, 2001

(86) PCT No.: PCT/GB01/02212

§ 371 (c)(1),
(2), (4) Date: Mar. 24, 2003

(87) PCT Pub. No.: WO01/87499

PCT Pub. Date: Nov. 22, 2001

(65) Prior Publication Data

US 2003/0164175 A1 Sep. 4, 2003

(51) Int. Cl.
*B24D 15/00* (2006.01)

(52) U.S. Cl. ..... 451/523; 451/532; 451/533; 451/535

(58) Field of Classification Search ..... 451/523, 451/524, 525, 532, 533, 538, 535, 490, 491, 451/446, 60
See application file for complete search history.

(56) References Cited

U.S. PATENT DOCUMENTS

| | | | | |
|---|---|---|---|---|
| 3,703,739 A | | 11/1972 | Young et al. | |
| 4,437,271 A | | 3/1984 | McAvoy et al. | |
| 4,486,200 A | * | 12/1984 | Heyer et al. | 51/295 |
| 5,626,512 A | * | 5/1997 | Palaikis et al. | 451/536 |

FOREIGN PATENT DOCUMENTS

| | | |
|---|---|---|
| DE | 3127860 | 3/1983 |

* cited by examiner

*Primary Examiner*—Dung Van Nguyen
(74) *Attorney, Agent, or Firm*—Synnestvedt & Lechner LLP

(57) ABSTRACT

This tool applies treatments to surfaces by rubbing. It employs a mildly abrasive body of compacted non-woven fibres to carry and release fluids onto a surface as it cleans and massages the surface. It comprises a spill proof rubbing applicator capable of dispensing chemical substances ranging from low viscosity liquids to fine dry particulate and includes slumes and gels. The tool is provided with means of removing dirty used fibres from its treatment face.

20 Claims, 3 Drawing Sheets

APPLICATOR TOOL FOR TREATING SURFACES

FIELD OF THE INVENTION AND BRIEF SUMMARY OF THE INVENTION

The present invention relates to a tool incorporating a body made with entangled non-woven fibres carrying a fine abrasive, which body is compacted and a fluid is dispersed therein for subsequent transfer onto a surface during rubbing.

If compacted sufficiently an entangled non-woven fibre body carrying mild abrasive will retain low viscosity liquid between its fibres by absorption. When a surface is abraded with this loaded body, it raises the free energy of the surface causing liquid to transfer from the fibres onto the surface. Such an applicator is essentially spill proof because it only releases liquid when rubbed against a surface.

Other fluid materials like dry or wetted fine particulate or gel can also be dispensed with such a tool and rubbed onto a surface. Because these materials may not flow as freely as tow viscosity liquids their deposition behaviour is likely to differ but the applicator remains essentially spill proof.

The compacted fibre body of the tool may be a flat web, or a stack of webs forming a rectangular Layered block, or a rod shape made by stacking many discs, all held tightly together by breakable ties. The stack is stored in a container that may also act as a tool holder. Soiled used layers on a stacked block may be peeled off to expose fresh loaded fibre. Alternatively a rod shaped tool can be made by tightly coiling up a flat web to form a roll which is forced into a tool holder resembling a beefed up lipstick or glue stick dispenser. A cutting device that acts like a pencil sharpener to remove and store used dirty fibre and is housed in the tool end cap.

Therefore, this is a tool for applying fluid treatments to a variety of surfaces, which tool employs an assembly of compacted entangled non-woven fibres as both a storage and application medium. The fibres may be either organic or inorganic or some combination thereof and generally manufactured. The fibres are solid and therefore do not depend upon a cellular structure to retain fluid The body absorbs fluid between the fibres by surface energy effects. The fibre body is held within a toot holding device that may also be an enclosure with an opening through which at least part of the fibre body is exposed. This exposed surface acts as a mild abrading tool, a polishing or massage pad, depending upon the fibre body which may range from soft almost non abrasive up to very hard and highly abrasive. The abrasive may either be dispersed loose between the fibres or bonded thereto.

BRIEF DESCRIPTION OF THE SEVERAL VIEWS OF THE DRAWINGS

The invention is described with the aid of the following drawings.

DETAILED DESCRIPTION OF THE INVENTION

Figure 1A:
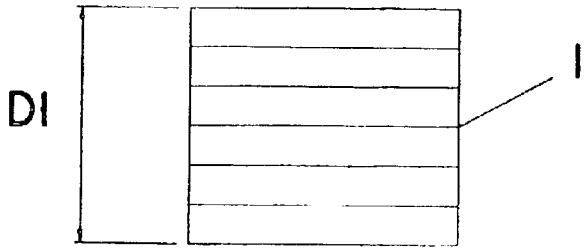
FIG. 1*a* shows a side view of an un-compacted stack of six layers of fleece.

In one aspect, this invention provides an applicator tool for dispensing fluid material while abrading a surface, comprising:

a tightly compacted body of non woven, mildly abrasive, essentially non-compressible fibres between which can be stored the fluid to be dispensed, the body having a face from which that fluid can be dispensed (by rubbing that face against a surface);

a holder for the body, in or on which holder the body is mounted leaving that dispensing face exposed; and means enabling the removal of worn, dirt laden fibres from that dispensing face.

The invention provides an applicator, a tool for dispensing a thin even layer of fluid material onto solid surfaces. In the case of metal surfaces typical functions for the applied material may be an etching agent, degreasing agent, a lubricant, a corrosion inhibitor an adhesion enhancer, a mould release agent, a friction enhancer, a sealant, a primer or stripper, a surfactant or an adhesive. Alternatively in the case of timber surfaces—thinned bees wax, sealants, colourings, grain fillings, adhesives, primers etc. In the case of ceramics or glass an adhesion enhancer wetting or release agent might be beneficially applied. Other uses include the application of adhesive to paper or cloth, application of cosmetics and skin medication, waterproofing of fabrics and leather, or for imparting scent into items like garments or personal effects. Also the tool is useful for invisibly marking objects for security use with trace elements such as fluorescent dye which when rubbed into an absorbent surface is very difficult to remove. The tool is unsuited for applying ink or paint because the layer left is so thin that it is barely visible.

In all of the above cases an abrasive is used within the fibre body of the tool. The abrasive may be attached to the fibre or distributed between the fibres. The grade of the abrasives vary according to the purpose for which the tool is used and may in principle vary from something as mild as talcum powder to aggressive diamond paste. Most commonly the abrasives are either alumina or silicon carbide grit size 320 to 80, but can be a powdered metal silicate, for example talc—magnesium silicate or a zinc silicate. In powder silicate form it can act initially as an abrasive to remove adsorbed and some absorbed and soft oxide then, as it encounters the harder substrate it is no longer hard enough to abrade and may then be deposited onto the surface by continued rubbing.

The abrasive smoothes and cleans a surface of contaminants adhering to the surface such as corrosion and absorbed layers. The abrasive action raises the free energy of the surface, which as noted in the introduction aids the dispensing action.

Light abrasion with a flexible material like a non woven nylon fleece carrying mild abrasives bonded onto its fibres is an efficient means of cleaning metal and other hard surfaces of oxide and adsorbed contaninants. After cleaning oxide will normally reform immediately. Therefore any conditioning material released by the tool as it cleans may be preferentially absorbed into a forming oxide.

The cleaning action is mostly limited to the oxide level on hard materials but may still reduce micro roughness. In the case of softer surfaces like timber the smoothing is more significant. In the case of leather or skin, dry scale dirt and adsorbed matter is removed and typically the surface is opened up and slightly roughened. The action of this tool is unsuited to general cleaning duty like a scouring pad, which, although it may use similar non woven materials it must remain open in structure so that water can pass freely through the pad to remove dirt and melt and release the soap condensed onto the fibres. Thus a distinguishing feature between this tool and a scouring pad is the fibres of the tool are compacted and retain dirt which is removed by removing the dirty fibres.

Within the body of the tool individual fibres being solid are not easily compressed and the term "essentially non-compressible fibre" is used here to mean that. The non-woven fleece is squeezed together and compacted to reduce fibre spacing rather than each fibre undergoing an actual reduction of volume due to surface pressure. The aim is to bring the fibres sufficiently close together for surface energy effects, later referred to as the energy of adhesion, to retain fluid material suspended between fibres, which behaviour is akin to capillary action. However capillary action is concerned with fluid transported through narrow regular shaped tubes such as fibres with hollow or cellular structures like those in plant stems or in marker pens. Nevertheless fluid is retained between the non-woven fibres by similar surface energy effects as cause capillary flow but the highly irregular spacing and random direction of the fibres impedes organised flow. Under these conditions material tends to be retained indefinitely unless exposed to a high gravitational force or surface energy. This loaded fluid cannot be easily squeezed out because of the stiffness of the compacted fibre. The stiffness being the result of the fibres—which are tangled and crinkled and become interlocked and resist further compression, although the body retains some useful flexibility overall, it does not change volume significantly when flexed. The retained flexibility provides useful compliance and softness at the rubbing interface allowing the tool to follow surface micro roughness when rubbed against a surface.

The body of the tool is preferably assembled from commercially available abrasive coated fleece with a springy lofty open structure such as supplied by among many, by the 3M Company under their Scotch-Brite Brand or the Norton Company under their Bear-Tex Brand, both of which are registered marks. While there are user advantages associated with this open structure in some instances like the case of the earlier mentioned scouring pad. The open lofty feature is actually the result of the way the fleece or web is manufactured. Industrial grade abrasive web or fleece is manufactured from crinkled nylon to help provide the natural spacing. The un-coated fibres comprising many short lengths are prepared by blowing and combing into a jumbled up fluffy fleece or mat. A common fibres being those made by DuPont de Nemours (Deutschland) Gmbh described as Nylon 17 dtex, 58 mm 3030. The fleece is coated with resin carrying abrasive and cured These fleece are produced as broad strips typically 1 meter wide then bulked as rolls containing typically 30 meters prior to conversion into a form suited to some specific purpose. Most commercially available products are made in a standard fleece thickness of about 6 to 8 mm nominal. Their stiffness is varied with the diameter of the fibre, which generally increases with the coarseness of the abrasive grains used. These open non woven fleeces are sometimes compacted then impregnated with a hot melt adhesive or curable resin to provide stiff abrasive tools ideal for high speed wheels, squeegee pads or wringer rollers but this compacted material was found to be too stiff for use in the applicator tools of the invention.

The preferred way of holding the fleece compacted in block form is with barbed nylon ties that act as staples. For tools using rolls, these may be simply rolled up tight and forced into parallel tubes, some narrowing slightly towards the orifice to provide more compaction at the orifice. This was found to increase the amount of liquid that could be loaded without risk of it seeping out. Other methods of retaining compaction between several layers of fleece include cross-stitching and the welding of filaments with heated needles, which may use the filaments of the fleece or separate filaments. Illustrated examples of these are provided later.

A means of retaining and holding said body is provided. The body of the tool needs protection from atmosphere to prevent evaporation as will be explained later and this may take the form of a flimsy plastic cover for block like tool bodies, which in essence is a sealed package that also prevents contamination during storage. When removed from the package the rectangular body is mounted in or on a holding device like a tool holder of some kind. An example of this is illustrated later where the tool holder is a simple extruded plastic handle that grips the side of the fibre body.

An alternative is to place the body of fibre within a closed container or holder. Then there is needed some means of urging or pushing the abrasive out of the container or holder, little by little as it is used. As in the previously mentioned case of the glue-stick dispenser, a convenient way is to use a screw mechanism coupled to a knob or grip at the base of the tool. Upon turning this the abrasive body slides outward. For automatic applications other means would probably be used to drive the abrasive out such as a servo-controlled electric or hydraulic actuator.

Ideally the container should be made of a similar material to the fibre or have a similar or slightly lower surface energy. The choice of correct materials ensures that during storage the fluid remains preferentially attracted to the fibre and will not migrate to the inner surfaces of the container and then leak or seep out should the container not be properly sealed, It is difficult to provide precise guidance on this detail and each case needs to be carefully considered on its merits and suitable material combinations tested. Successful tool holders for use with coated nylon fibre tools have been made in polypropylene and polyethylene but the surface energy of polycarbonate and ABS proved to be too high.

In use the exposable face of the body is prone to accumulate dirt and debris as it cleans the surface and a means is provided for removing accumulated dirt and worn spent fibre from the surface of the body. Two approaches are employed, either a used layer is peeled of and discarded or a slice of the body is cut off.

In the case of a block tool made with a laminated construction and the laminations run parallel to the rubbing area, the coupling between the laminated layers is designed to allow a used layer to be peeled of and discarded. The ties are designed to break off level with the new surface as each layer is peeled off and this is achieved by the peeling action bending and fracturing each tie at small indentations (weak-spots) spaced along each tie. These ties can be made from similar but larger diameter fibres as used within the body.

In the case of a tool holder like a glue stick dispenser any protruding used fibre is easily cut off with a small saw blade or hack saw and there is illustrated later how a saw blade may be incorporated into the top cap of the tool. Also a trimmer blade may be incorporated into the sealing cap which functions a bit like a pencil sharpener to shape the end face as the cap is rotated against the body. A spiked plate with cutters may also be incorporated into the cap to so that as turned this comb's and drags out spent fibres and cuts them and deposits them into the cap.

If the fibre stick or column is formed as a stack of stamped or otherwise shaped flats, then this is analogous to a stack of individual tools using ties. As they are compacted within a constraining body they tend to bind together and grip. Combing the surface to break a few fibres, which are then more likely to tangle with another layer of non-woven material, enhances this gripping feature. And again once expended each disk is simply peeled off and discarded. This exposes the next layer or new tool.

In principle the fibre body may comprise of fibres of almost any materials such as plastics; glass or carbon based materials or metals. In practice the preferred fibre is nylon with which may be blended fibres made from other materials. Adequate cleaning was found when small amounts of chopped glass fibre of no more than 5 mm average length was blended with un-coated non-woven nylon that was used in place of conventional abrasive. Up to 5 % by weight of glass was found to be a practical value.

It may on occasions be helpful to employ inorganic material such as glass fibre exclusively where for instance organic polymeric materials are incompatible with the local chemistry. It is more difficult to form a lofty open structure with glass than nylon fibre. Layering small amounts of bundled nonwoven glass fibre between thin layers of woven glass fibre mats was found to give make a practical tool. Hence under these circumstances the bundled fibre provided the bulk storage by wetting and the woven material acted as a porous membrane and mechanical retainer.

Other fibre materials such as for example aramids, polyesters or polyamides may be used individually, or combined and chosen to meet the local surface energy and chemical need. The surface energies of typical polymeric materials like polyethylene copolymer range from 20 to 24 dynes/cm up to 40 dynes/cm for polycarbonate and some nylons.

The purpose of the applicator of the invention is to apply fluid to a surface that needs some sort of treatment, and in a second aspect, the invention provides a method of applying fluid material onto a surface using an applicator tool of the invention having the fluid material pre-loaded into the tool's fibre body, in which method the exposed dispensing face of the body is rubbed against the surface to transfer fluid thereto.

This invention provides a method of applying and spreading fluids evenly and in small amounts, even traces amounts. The fluid material in liquid or fine particulate form or a combination thereof. The term "trace amount" means a very small amount perhaps in the case of a low viscosity liquid only a few molecules thick on average, which may influence but may not necessarily dominate or totally change the chemical nature of a surface. Such a material in liquid form may be a wet chemical composition, often a blend of several elements designed to fulfil a specific function—for example to act as a surfactant and improve wetting. In fine particulate form the material is a powder again chosen to provide or fulfil a particular function, for example a zinc powder that acts as a sacrificial corrosion element on steel. By combining a fluid like a surfactant with a particulate improves coverage is obtained because the fluid is able to wet and penetrate and carry particulate into troughs and microscopically small imperfections on a surface.

These applicators are tools for treating surfaces and the treatment involves varying combinations of cleaning, smoothing, dispensing and rubbing-in (massaging). This treatment actually changing the condition of a surface on an object that is rubbed with the tool. The term condition may embrace both the physical and the chemical nature of a surface, both of which may be influenced by use of this tool. First the physical nature, for example roughness can be reduced and the surface cleaned of dirt adhering to the surface as it is scraped off by mechanical abrading action. Second, abrading the surface layers off changes the surface chemical nature as adsorbed and most absorbed material is removed. In removing these layers some of the surface oxide is scraped off by the abrasive action and this raises the surface free energy which aids wetting, adhesion and adsorption of individual conditioning molecules within the dispensed material.

The term "wetting" describes the ability and ease by which a fluid can spread over and adhere onto a solid surface. Wetting is controlled by surface energy, for example, optimum wetting occurs when individual molecules within a fluid are attracted to and attach onto the surface in preference to remaining within a bead or droplet of fluid lying upon a surface. Thus under the operating conditions of this applicator tool, the energy conditions are such that flowable materials, and in particular individual molecules within a fluid are attracted by and held or suspended between the fibre surfaces while they are stored within the fibre body.

As a guide, when treating metals with a tool whose body comprises abrasive resin coated nylon, transfer of conditioning fluid onto the treated surface occurs when the surface free energy (measured in dynes/cm) for the abraded surface is about 10 dynes/cm greater than the surface tension of the liquid (also measured in dynes/cm). The difference between these two quantities being known as the energy of adhesion. The surface free energy level of the coated fibre being ideally somewhere between that of the fluid and the surface being treated, There are occasions when the surface free energy of the treated surface may be above these levels in which case material will transfer upon touching, and before rubbing although rubbing will still be beneficial to clean the surface. The actual spacing of the compacted fibres needs to be determined by experiment and verified for each type of fluid. As an example a highly mobile low molecular weight surface-active fluid like a Polydimethylesiloxane water proofing agent which has low surface tension and a high propensity to creep because of its unique low polar nature will wet the coated nylon fibre very readily. For optimum retention of this material it requires the spacing between the fibres be minimised. In contrast a fluid like de-ionised water. for example, which has relatively high surface tension, because of its strong hydrogen bonding between molecules can be retained by a body with larger spacing between the fibres. Therefore the average spacing between fibres will be determined by the character of the material being stored therein and should be optimised by experiment.

During loading, providing energy is available and the materials are liquid with a suitably low viscosity, the material will be drawn into the body and continue to spread and wet the surfaces within the fibre mass until the entire mass approaches saturation. The loading process is aided by gravity if the materials (fluids) are applied to the highest surface, If the energy difference available for driving the wetting falls below that needed for further wetting, no further material can flow in unaided. As already noted it is the intermolecular forces that ultimately determine the distribution of the fluid across the fibres, seeking the lowest or minimum energy difference between the solids and liquids, which once reached, this is a stable situation. Once this stable state is reached the loaded material remains held wetted onto the fibres which constitutes the non-spill feature. This condition remains stable until the system is subjected to a change of energy distribution that may induce out flow or evaporation.

If a container with a narrowed orifice is employed and gaps are left between the body and its container, then providing the container is leak proof the gaps can be filled with free fluid by saturating (over loading) the body. However, under these conditions the applicator may the loose its non spill feature because the surface energy effect that normally retains the fluid is unlikely to be effective under these conditions.

If the material being loaded in the fibre body is a fine dry particulate then a different procedure must be followed. Although the dry particulate is fluid it does wet like a liquid. In this case the body needs to be placed and held on a vibrating table and the particulate applied in small quantities to an upwards facing surface so that the powder is shaken down into the fibre body a little at a time. Likewise in use the tool needs to be shaken or vibrated by tapping it against the surface to encourage the release of particulate. A particulate will firstly need much tamer gaps and second exclusively surface energy effects do not retain it although electrostatic retention can be significant. Indeed in some cases it may be advantageous to treat the fibre with anti static to prevent the dispenser clogging up. Mechanical interlocks will form and these need to be released and overcome by vibration. Despite this limitation the applicator is still a very convenient dispenser of fine particulate, especially when it needs to be applied with a liquid.

If the fluid material being loaded is a wet slurry or gel, then forcing the material into the body under pressure best does this and vacuum impregnation is a convenient way of achieving this.

In use the slurry or gel is wiped onto the surface, but the fibre retains these thicker materials only partly by adhesion and partly by mechanical interlock. to use, if gel, slurry or particulate does not flow from the applicator tool it is necessary to trim the fibre back or peel off a layer to gain access to more gel stored within the fibre body.

For the fibre to be able to raise the surface energy sufficiently to transfer a liquid, the fibre, or more precisely some part of its coating needs to be hard enough to remove part of the oxide layer from the surface being treated, but it does not necessarily need to be harder than the substrate or be able to remove substrate material.

During rubbing there is also an energy change within the fibre body and an energy gradient is established across the fibres especially near the surface since the free energy of the rubbing fibres will also increase slightly during rubbing due to friction induced electrostatic effects. As a result material transfers within the body from fibre to fibre in the direction of fibres at the rubbing interface. The energy gradient across the fibres regulates the flow and ultimately limits the amount of material transferred. The resin coating covering the nylon fleece has a surface energy above that of the nylon so if this is worn off by mechanical abrasion any increase in surface energy within the body due to rubbing tends to be offset by a loss of resin coating.

Various examples will be described with the aid of the drawings.

EXAMPLE 1

Describes How to Make a Body of Compacted Fibre by Reference to FIGS. 1*a, b* and *c*

A strip of medium density non woven abrasive fleece colour coded maroon carrying 220 grit similar to 3M Scotch-Brite 7447 or Norton Bear-Tex 747 was cut into six small sheets 100×30 mm and stacked as shown in detail 1 in the side view of FIG. 1*a*. The natural height of this is marked on the diagram as D1.

Figure 1B:
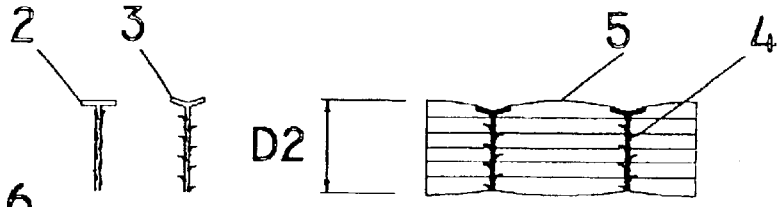
FIG. 1*b* shows a side view of the same stack held compacted with barbed ties.
Figure 1C:
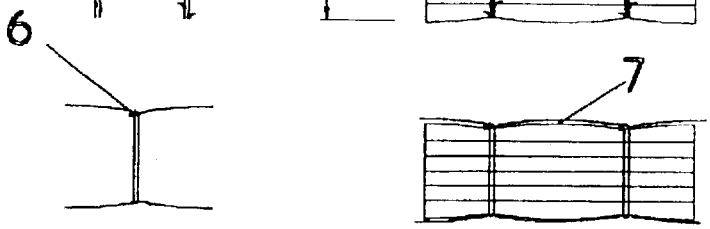
FIG. 1*c* shows a side view of the same stack held compacted with stitches.

Nylon staple ties with barbs moulded or cut along their length are shown closed 2 and open 3. As 1 is compacted down the staples are forced into the body spaced roughly 10 cm equi distant and shown in the cross section view FIG. 1*b* and detail 5. The action of pressing the staples in compacts the layers down to slightly below height D2 in FIG. 1*b*. As the insertion and compacting force is removed the fleece attempts to expand and the barbs 4 engage with the fibre and open up, which holds the assembly to the compacted height D2. The amount of compaction may vary and will generally be between 25 and 75% depending upon the stiffness of the fibres. An alternative method of holding the non-woven fleece compacted is to use a stitch 6 as shown in 7 FIG. 1*c*. Alternately instead of threading the stitch if nylon filament is used then they may be welded by inserting with heated needles pressed into a compacted sheet (not shown).

EXAMPLE 2

Figure 2A:
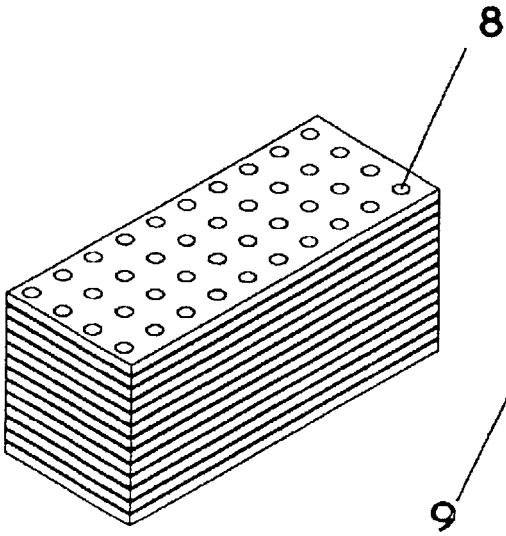
FIG. 2*a* shows a general view of a compacted stack with ties.
Figure 2B:
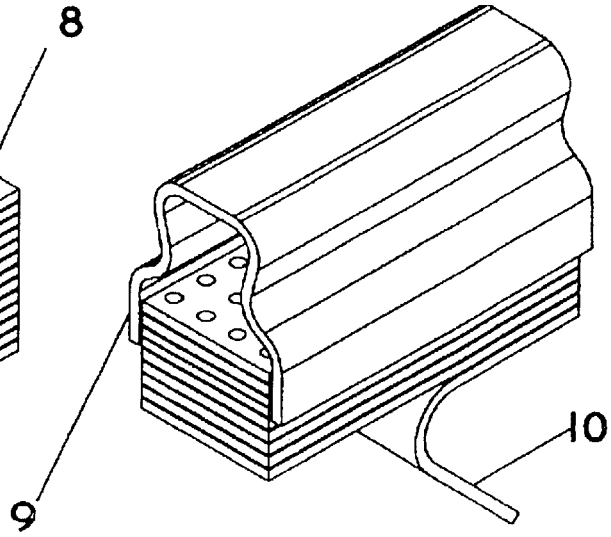
FIG. 2*b* shows the same stack held with a tool holder and a peeling layer.

Describes How a Body of Compacted Fibre is Used by Reference to FIGS. 2*a* and *b*

Similar flat compacted sheets as used in Example 1 are stacked 8 and stapled then loaded with about 10 mi of Polyalkyleneoxide Modified Heptamthytrisiloxane a copolymer which acts as a surfactant and is useful for improving epoxy adhesive and paint bonding onto steel and aluminium. The surface tension for this chemical material is quoted as about 23 mN/m. The chemical is dripped onto its upper surface an allowed to soak in.

The loaded block is then placed inside a sealed polyethylene container for storage until used. The surface energy of the polyethylene is typically 29 to 31 mN/m and the coated non-woven Scotch Brite is estimated at about 45 mN/m. Hence the impregnated fluid is more strongly attracted to the compacted fibre and does not migrate onto the polythene.

To prepare the impregnated stack for use, it is removed from it package and placed in a holding device—for example a tool holder as shown at 9. This simple extruded plastic or metal handle has grips on its inner surfaces (not shown) to grip and retain the block, The layers are tied together 8 so as to permit individual sheets to be peeled off after use as shown at 10, without relaxing the compression of the remaining sheets. The staple 6 and 7 shown in FIG. 1 provides the most practical way of achieving this.

EXAMPLE 3

Figure 3A:
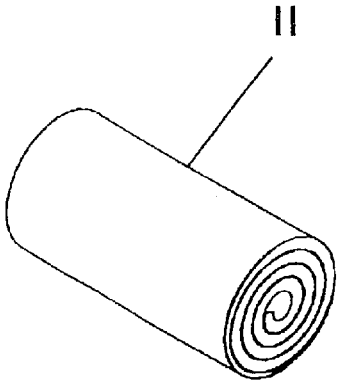
FIG. 3*a* shows a compacted role of fleece.

Describes How a Roll Tool is Assembled and Used by Reference to FIGS. 3*a, b* and *c*

An example of a cylindrical tool using a compacted roll 11 is shown in FIG. 3*a*. This is made with similar material as used in example 1. A strip of 3M 7447 material was cut 200 mm×80 mm high and tightly rolled onto a cardboard mandrel 4 mm outside diameter and 80 mm length similar in strength to a drinking straw. The final outside diameter of the roll was 26 mm and it was 83 mm high. The mandrel was left in place and the roll was taped down the side over the material edge to hold it compacted. The roll was anchored at its base by crimping into a cup shape moulded polythene nut (not shown) that runs on the thread of the central internal moulded screw (not shown). This screw is sized to pass through the mandrel at the centre of the roll and is connected to the hand nut at the bottom. As the hand nut is turned it draws the roll down into the moulded plastic case 13 to produce an assembly generally as shown at FIG. 3*b*.

Figure 3B:
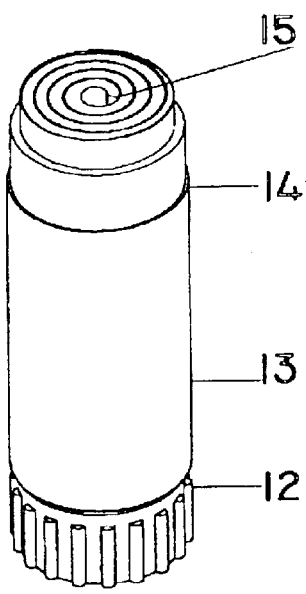
FIG. 3*b* shows a compacted role held within a dispensing tool holder.

FIG. 3*b*. Shows an assembly using a moulded housing similar to those used for a glue stick paper adhesive dispenser. A typical unit stood 70 mm tall and 29 mm diameter. The internal diameter of the moulded plastic tool holder was about 26.5 mm. The ledge detail on the outside of the tool 14 acts as a stop for the container lid, designs for which are shown in FIGS. 4 and 5. The hand nut with a knurled grip, 12 is coupled to a moulded screw that runs two thirds of the way up the centre of the cavity inside the cardboard mandrel. Upon turning the hand nut the roll is raised and projects out of the end—ready to be rubbed against a surface. For use the fibre roll 15 is positioned typically between 2 and 5 mm above the rim 16. A tool like this will carry about 5 ml of low viscosity (20 $mm^2/s$) fluid or 10 ml or more of a fluid with a viscosity of about 100 $mm^2/s$.

By way of example the chemical was added to the compacted fibre mass within the cavity by dripping 5 mt of 30 $mm^2/s$—viscosity polymethylehydrogen siloxane copolymer onto the exposed end of the abrasive role before the sealing cap was placed on to seal the container. After three months storage no trace of leakage or evaporation was detected. The loaded material was selected to make the tool suited for treating metal surfaces like steel and imbuing them with a useful increase in rubbing friction and grip between touching metal surfaces.

This tool worked satisfactorily as a friction enhancer, having treated approximately four hundred parallel shank drills to reduce slippage when gripped by keyless chucks. The increase in frictional grip observed was typically in excess of 50%. The tool was also used to treat cross head and cross-slot screwdriver tips to reduce slippage. The jaws of a "C" spanner were treated to prevent the spanner slipping off the hexagon form being held and turned.

Figure 3C:
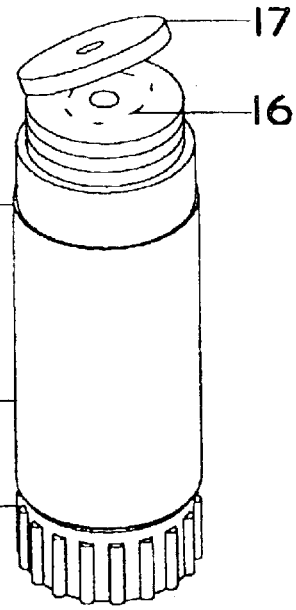
FIG. 3*c* Shows a circular compacted stack within a dispensing tool holder.

An alternative construction for the filling is shown in FIG. 3*c*. Here individual Compacted discs of non-woven material—the discs are stacked and held compacted with barbed staples 16 running the length of the column as illustrated in FIG. 1. This permits a soiled and spent layer to be peeled off after use without reducing the compression of remaining discs. Detail 17 shows a disc being removed.

EXAMPLE 4

Describes the sealing cap and dresser used with the tool of FIG. 3 described with reference to FIGS. 4*a* and *b*

Figure 4A:
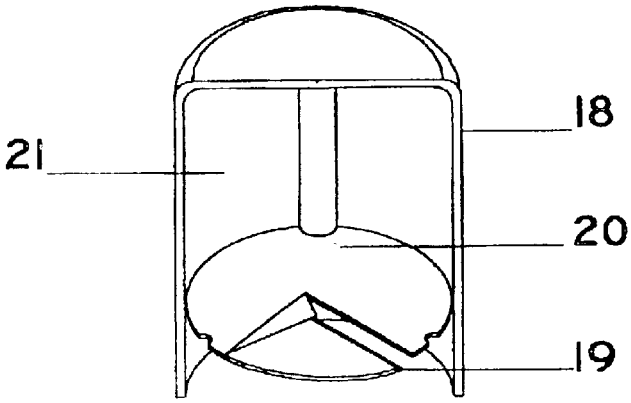
FIG. 4*a* shows a cross section of a cap with dresser for the tool shown in 3*a;*
Figure 4B:
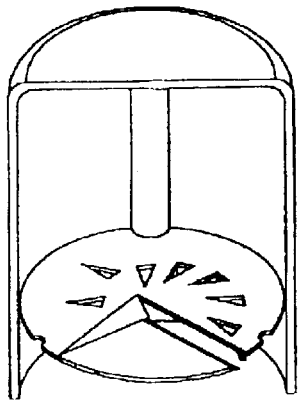
FIG. 4*b* shows how a dressing comb is added to dresser plate.
Figure 5:
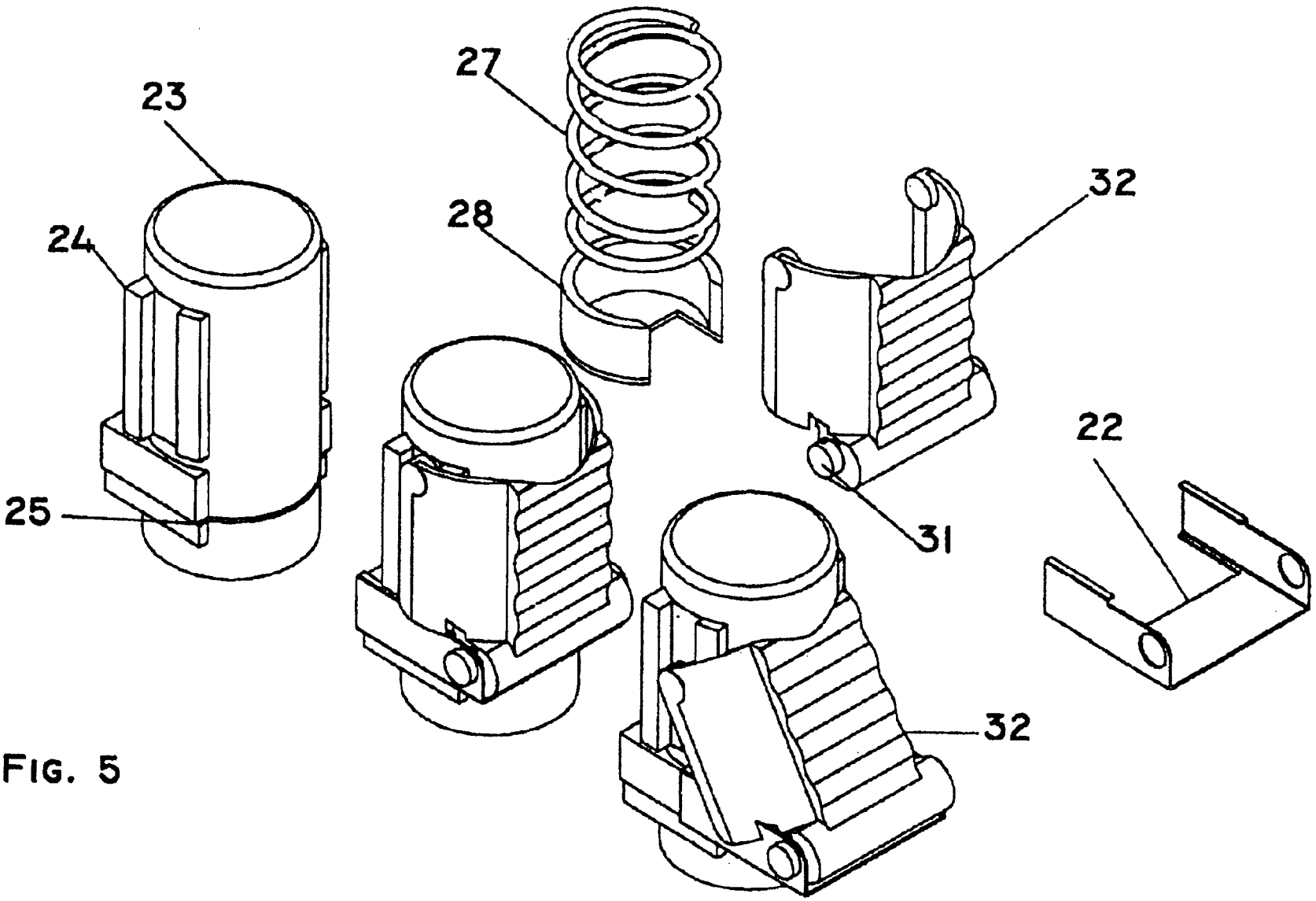
FIG. 5 shows the assembly an alternative cap with dresser employing a saw blade.

FIG. 4*a* shows a cross section of a cap 18 suitable for use with the containers shown in FIG. 3. which fits snugly against 14 to provide a seal. The cap contains a cutting blade 19 set in a steel disc 20 for dressing the end of the fibre roll to remove used spent and dirty fibre. The space above the cutter 21 is provided to catch the dressing debris. Dressing is done by elevating the fibre role 15 so that the roll makes firm contact with the metal plate 20 and turning the cap 18 relative to the fibre body. FIG. 4*b* shows how additional tags pierced in the plate 20 and pressed downwards so to form pointed teeth that act as a comb as they engage with the top of the roll and when the cap is turned relative to the body. These teeth improve the dressing and cutting action of the cutter.

EXAMPLE 5

Describes How a Saw Blade may be Incorporated into the Cap for Dressing the Roll End and is Described with Reference to FIG. 5

FIG. 5 shows another device for dressing the roll in which a serrated saw blade 22 is forced against the side of the roll by the thumb pad 32 as it is turned by hand to shear off the spent fibre at the end of the roll. The waste fibre is trapped and held securely within the cap cavity. This is used when the device shown in FIG. 4 proves inadequate perhaps because the fibres are too tough to be easily sheared. Here a moulded cap 23 is provided with diagonal moulded guides 25 in which the saw blade slides. The cutter 22 is operated (forced down) by thumb pad 32 sliding in another set of guides 24 moulded along the side of cap 23.

The device is assembled by first inserting the spring 27 and its half washer 28 into the moulding 23. Then the saw blade 22 is slid into its guide slot 25 and the thumb pad 26 is engaged with its guide slot 24 and the saw blade is sprung onto the pips on the button as shown in 31. A wire spring placed under the thumb pad (but not shown) helps to pop the thumb pad 26 into the position shown at 32 after it is released from its normally locked position. This opens the saw jaw to allow the roll to be forced up past the saw by operating the hand screw 12 shown in FIGS. 3*b* and *c*. The front of the saw 22 carries fine sharp serrations in two directions so that it will cut in either direction. In use, the assembled cap device is placed over the projecting used end of the roll and pressure is applied to the thumb pad 26 as the body 23 is turned relative to the fibre roll. The thumb pressure on the thumb pad forces the saw blade 22 into the side of the roll which shears off fibres leaving the end of the roll trim and square. The debris are again trapped in the cap and retained as happens in FIG. 4.

TEST RESULTS

Test 1. To Measure Body Leakage

This test measures the retentive character of a compacted densified mass of abrasive coated non-woven fibre, tests were performed with three fluids of low viscosity known for their ability to creep and penetrate. These were a diluted phosphoric acid rust remover; a hydrocarbon based water-repellent surface preservative similar to WD40 and a Polydimethyle siloxane formulation for waterproofing. The viscosities of the acid and hydrocarbon were approximately 30 $mm^2/s$ for the first two materials and 50 mm/s for the siloxane. All their surface tensions were in the region of 24 dynes/cm.

Strips of 3M 7447 material were cut 150×40 mm and rolled up into tight rolls of 20 mm diameter average. The length extruded slightly during rolling to 42 mm. The three rolls were bound up with nylon thread. The volume of the rolls was about 30% of that of the original fleece. The rolls were stood on end and 2 ml of fluid was applied to each and allowed to soak in. After 15 minutes the rolls were laid horizontally on clean paper towels and inspected and weighed every hour for the first 10 hours for evidence of leakage. They were then weighed daily for two weeks and thereafter monthly for six months. The parts were tested in open laboratory conditions and the average temperature for the period was 15° C. Relative humidity ranged from 5 to 25% averaging about 10% over the 6 month test period.

After 10 hours slight leak developed with roll holding phosphoric acid. This stopped after 24 hours having lost 2% by weight of the fluid. No further leakage occurred and a weight loss of 7% inclusive was recorded over 2 weeks. After 6 months 70° h. by weight of added material was lost while lying on a towel in open atmosphere but there was no evidence of out-flow. Therefore this loss was attributed to evaporation. A similar role stored in a polyethylene bag lost only 3 % by weight over the same 6-month period.

The hydrocarbon based fluid showed no evidence of leakage over the initial two-week test period. There was a 5% loss of fluid by weight over this fourteen-day period, which was attributed to evaporation and 81% by weight was lost over 6 months. Again similar samples stored in sealed plastic bags showed only 2% loss of fluid by weight over 6 months.

The siloxane filled roll showed no sign of leakage for 4 days, thereafter a slight seepage was noted and a loss of about 9% by weight of fluid was measured over 14 days, the rate of escape appearing to steadily rise. About 40% by weight of fluid was lost over 6 months but there was apparently little or no loss due to evaporation because this material was substantially no volatile. A parallel test with a similar roll sealed in a plastic bag showed about a 6 % loss in weight of fluid over 6 months, and this was accounted for by the transfer of material onto the inside of the sealed bag.

Conclusion

The test show that evaporation is the major loss mechanism and therefore the compacted fibre bodies should always be kept in a sealed container for storage.

The tests with the siloxane confirmed that the surface free energy of any packaging materials used to store or act as a tool holder for loaded fibre bodies should be closer to the surface tension of the loaded liquid than the fibre mass to prevent material migrating onto the inside of the package.

The test confirm that leakage or seepage is a second order effect, confirming the non-spill behaviour.

TEST 2

To Measure the Compressibility and Resilience of Industry Standard Non-woven Abrasives, Typical of those used within the Tool of the Invention Pads of 3M 7447 material were cut 40×40 mm. The average height/depth as received was 8 mm.

A 1-kilogram weight was placed on the pad to compress it evenly. The compressed or "compacted" height was measured at 1.9 mm. The force was maintained for an hour at 18 degrees centigrade. After releasing it the pad height recovered naturally to about 7 mm. This confirms the view that a typical non-woven nylon abrasive can be compacted and is capable of recovering to a useful form.

The test was repeated with the fleece immersed in boiling water for 15 minutes. Subsequently the non-woven material recovered about half of its height i.e. to approximately 4 mm.

The test was repeated a third time in an oven heated to 150 centigrade, after which the fleece recovered only to 3.1 mm high. Electron micrographs showed considerable damage due to the resin coating becoming separated from the nylon fibre.

Conclusion

The tests show that it is preferable to compact the fibre at low temperature rather than heating them because of the risk of damage to the resin binder although it may be helpful to heat the fleece moderately to about 50° C. during compaction.

TEST 3

To Measure Typical Dispensing Rates of Applicator Tools.

Three rolls were prepared as described in Test 1 above and filled with 2 ml of phosphoric acid, low viscosity hydrocarbon like WD40 and a 50 $mm^2/s$ polydimethyle siloxane respectively.

Each roll was rubbed end-on against a degreased mild steel plate on in a test rig. The rubbing rate was set at 300 mm/sec and the load applied was 200 gram distributed over the 20 mm diameter end face. The rubbing action was a reversing stroke of 150 mm long with 5 mm index on each stroke. Thus total abraded area is 45,000 $mm^2$ per minute. Assuming all three materials have a specific gravity of about 1, and ignoring evaporation effects the deposition rates were calculated to be approximately as follows:

| Material | Dispensed weight/minute | Estimated film thickness |
|---|---|---|
| Phosphoric acid | 0.26 gm | 0.58 micron |
| Hydrocarbon blend | 0.35 gm | 0.78 micron |
| Polydimethyle siloxane | 0.38 gm | 0.84 micron |

Estimating the deposition rate is complex because it is a function of surface energy in this case the deposition rate might be expected to fall off as rubbing proceeds, but that assumes perfect cleaning which is unlikely. Therefore the likelihood is that each pass cleans the surface a little more and deposits about equal amounts up to about five passes after that deposition rate fall off.

What is claimed is:

1. An applicator tool for dispensing fluid material onto a surface while mildly abrading that surface, the tool comprising:

a tightly compacted body of non-woven, mildly-abrasive, essentially non-compressible fibres between which can be stored the fluid to be dispensed, the body having a face from which that fluid can be dispensed by rubbing that face against a surface;

a holder for the body, in or on which holder the body is mounted leaving that dispensing face exposed; and means enabling the removal of fibres from that dispensing face.

2. A tool as claimed in claim 1, including an abrasive material attached to the fibres.

3. A tool as claimed in claim 2, wherein the abrasive material is alumina or silicon carbide grit, or a metal silicate powder.

4. A tool as claimed in claim 2, wherein the fibres are nylon.

5. A tool as claimed in claim 1, wherein the fibres making up the compacted fibre body are crinkled, and form interlocks, thus resisting further compaction.

6. A tool as claimed in claim 1, wherein the compacted fibre body takes the form of a series of layers of compacted fleece held by barbed ties that act as staples, or a roll of compacted fleece held by a surrounding tubular shaped container narrowing slightly towards its orifice.

7. A tool as claimed in claim 1, wherein, to protect the fibre body from atmosphere, and to prevent evaporation, the body has a plastic cover.

8. A tool as claimed in claim 1, wherein the fibre body is mounted in or on a holding device in the form of a simple handle that grips the sides of the body, or is mounted within a closed container or holder which includes extrusion means associated therewith for pushing the body out therefrom, little by little, as it is used.

9. A tool as claimed in claim 8, wherein the fibre body is mounted within a tubular container and the extrusion means is a screw mechanism coupled to a knob or grip at the base of the tool which upon actuation causes the fibre body to slide out.

10. A tool as claimed in claim 9, wherein a holder for use with coated nylon fibre bodies is made of polypropylene or polyethylene.

11. A tool as claimed in claim 9, wherein the fibres are nylon.

12. A tool as claimed in claim 1, wherein the tool holder is made of a similar material to the fibre, or has a similar or slightly lower surface energy.

13. A tool as claimed in claim 1, wherein, to provide the means enabling the removal of fibres from that dispensing face;

a) the fibre body has a laminated construction, and the laminations run parallel to the rubbing area, allowing a used layer to be peeled off and discarded; or b) the fibre body is disposed within and projects from a capped tubular container, and the exposed end may be trimmed off using a blade or comb incorporated into the cap.

14. A tool as claimed in claim 1, including an abrasive material which is attached to the fibres and which is selected from the group consisting of alumina, silicon carbide grit, or a metal silicate powder.

15. A tool as claimed in claim 14, wherein the fibres are nylon.

16. A tool as claimed in claim 14, wherein the fibres making up the compacted fibre body are crinkled, and form interlocks, thus resisting further compaction.

17. A tool as claimed in claim 16, wherein the fibres are nylon.

18. A method of applying fluid material onto a surface using an applicator tool as defined in claim 1 and having the fluid material pre-loaded into the tool's fibre body, in which method the exposed dispensing face of the body is rubbed against the surface to transfer fluid thereto.

19. A method as claimed in claim 18, in which the pre-loading occurs prior to the fibre body being mounted in or on its holder, and involves:

a) where the fluid is a mobile liquid, supplying it to the body's highest surface and using gravity to enhance its absorption;

b) where the fluid is a fine, dry particulate, supplying it to the body's highest surface and using gravity and vibration to enhance its absorption; and c) where the fluid is a wet slurry or gel, forcing it into the body under pressure.

20. A method as claimed in claim 19 wherein the fluid is said gel.

* * * * *